US007908883B2

(12) United States Patent
Wu et al.

(10) Patent No.: US 7,908,883 B2
(45) Date of Patent: Mar. 22, 2011

(54) REFRIGERATOR ACCELERATED HEAT EXCHANGER

(75) Inventors: Guolian Wu, Saint Joseph, MI (US); Steven J. Kuehl, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 526 days.

(21) Appl. No.: 12/105,528

(22) Filed: Apr. 18, 2008

(65) Prior Publication Data

US 2008/0196866 A1 Aug. 21, 2008

Related U.S. Application Data

(63) Continuation-in-part of application No. 11/644,558, filed on Dec. 22, 2006, now Pat. No. 7,730,742.

(51) Int. Cl.
*F25D 11/00* (2006.01)

(52) U.S. Cl. ..... 62/441; 62/515

(58) Field of Classification Search ..... 62/419, 62/441, 515, 530; 165/81, 104.31
See application file for complete search history.

(56) References Cited

U.S. PATENT DOCUMENTS

| | | | | |
|---|---|---|---|---|
| 2,991,048 | A | 7/1961 | Rabin | |
| 3,745,786 | A | 7/1973 | Laughlin et al. | |
| 5,099,913 | A | 3/1992 | Kadle | |
| 5,137,082 | A | 8/1992 | Shimoya et al. | |
| 5,157,941 | A | 10/1992 | Cur et al. | |
| 5,172,759 | A | 12/1992 | Shimoya et al. | |
| 5,295,532 | A * | 3/1994 | Hughes | 165/76 |
| 5,502,983 | A | 4/1996 | Dasher | |
| 5,826,442 | A | 10/1998 | Lee | |
| 6,532,751 | B1 * | 3/2003 | Schenk et al. | 62/66 |
| 6,793,010 | B1 * | 9/2004 | Manole | 165/122 |
| 7,073,347 | B2 * | 7/2006 | Hermes et al. | 62/515 |
| 2006/0179876 | A1 | 8/2006 | Yagisawa | |

* cited by examiner

*Primary Examiner* — Melvin Jones

(74) *Attorney, Agent, or Firm* — John W. Morrison; Diederiks & Whitelaw PLC

(57) ABSTRACT

A heat exchanger for a refrigerator includes a dividing wall that bifurcates the heat exchanger into first and second airflow passages. The fins include apertures therein, allowing for both horizontal and vertical movement of air through the heat exchanger. The dividing wall extends through the heat exchanger at an angle, which decreases the cross-sectional diameter of both the first and second airflow passages and results in accelerated air flow through the air passages. In use, air from the refrigerator is directed into the first airflow passage of the heat exchanger for heat exchange, and is then directed by curved baffles into the second airflow passage for further heat exchange. Air exiting the second airflow passage is then directed into a compartment of the refrigerator.

21 Claims, 8 Drawing Sheets

REFRIGERATOR ACCELERATED HEAT EXCHANGER

CROSS-REFERENCE TO RELATED APPLICATIONS

The present application represents a continuation-in-part of U.S. patent application Ser. No. 11/644,558 entitled "Accelerated Heat Exchanger" filed Dec. 22, 2006, pending.

BACKGROUND OF THE INVENTION

1. Field of the Invention

The present invention pertains to the art of refrigerators and, more specifically, to tube and fin-type heat exchangers used in domestic refrigerators.

2. Description of the Related Art

Refrigerators typically include one or more enclosures or chambers for storing food or other articles to be cooled or frozen. The refrigerator housing about these enclosures includes two intersecting fluid circuits: a refrigerant circuit and a cooling air circuit. The refrigerant circuit generally includes a compressor, a condenser and an evaporator with tubing between these elements to permit the flow of the refrigerating fluid. The condenser essentially exchanges heat from the refrigerator interior to the outside air. The cooling air circuit typically includes passageways for air to travel between the enclosures, the evaporator and an impeller, such as a fan, for causing air to flow within the air circuit. These two circuits intersect at the evaporator, which enables the transfer of heat from the cooling air to the refrigerating fluid.

Evaporators for refrigerators typically include a tube and fin-type arrangement wherein a serpentine tube containing the refrigerating fluid passes through the evaporator, with air paths over the serpentine tube defined by the longitudinal length of these fins. One example of such a tube and fin-type evaporator is shown in U.S. Pat. No. 3,745,786, issued Jul. 17, 1978.

It has been found to be desirable to increase the efficiency of such tube and fin-type evaporators and to decrease the size of the evaporator. An evaporator can be made more compact by, for example, increasing the density of the fins and/or by increasing the inlet flow velocity of the cooling air. However, if fin density is increased, the normal frost build-up on the fins can clog and close the flow passages for cooling air. With such an arrangement, more frequent defrosting is required, which significantly increasing energy consumption of the appliance. Similarly, increasing the flow velocity of the cooling air into the evaporator, such as by increasing the fan speed, results in more energy consumption and increases the overall noise level of the appliance.

Other previous heat transfer enhancement methods have been found to be disadvantageous when applied to refrigerators. For example, louvered or lanced fins are considered less effective than needed because of the relatively low flow velocities of cooling air in refrigerators and the frost build-up on the louvers. Additionally, evaporators having trapezoidally shaped fins, such as the evaporator shown in U.S. Pat. No. 5,157,941 issued Oct. 27, 1992, have been found difficult to manufacture.

In a manner directly analogous to evaporators, condensers in refrigerators also function to perform heat exchange operations. With respect to refrigerator condenser heat exchangers, efforts to improve heat transfer include extending secondary heat transfer surfaces as set forth in U.S. Pat. Nos. 3,785,168 and 2,359,926, for example. Additionally, it is known to provide a refrigerator with a condenser having a folded condenser tube and wire fins as seen in U.S. Pat. No. 5,502,983. However, as with fin-type evaporators, a more compact design closes the flow passages and slows the flow of cooling air through the condenser.

Therefore, there exists a need for heat exchanger for a refrigerator evaporator or condenser having an improved efficiency which is simple and inexpensive to manufacture.

SUMMARY OF THE INVENTION

The present invention is directed to a refrigerator tube and fin-type accelerated airflow heat exchanger having a dividing wall that bifurcates the heat exchanger into first and second air flow passages. Fins on the heat exchanger include apertures therein, allowing for both horizontal and vertical movement of air through the air flow passages. The dividing wall extends through the heat exchanger at an angle, decreasing the cross-sectional diameter of both the first and second airflow passages and resulting in accelerated movement of air through the air flow passages. The heat exchanger may be utilized in a condenser assembly and/or an evaporator assembly. The evaporator assembly may be situated along the back, bottom, top or sidewalls of the freezer compartment of the refrigerator, and preferably includes a fan to aid in air flow through the refrigerator's cooling air circuit. The condenser assembly is situated within a machine compartment of the refrigerator and includes a fan to aid in air flow through condenser coils.

In use, air from either or both of the fresh food or freezer compartments is directed into the first air flow passage of the heat exchanger for cooling, and upon exiting, is directed by curved baffles into the second airflow passage for further cooling. Cooled air exiting the second airflow passage is then directed into either or both of the fresh food or freezer compartments.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
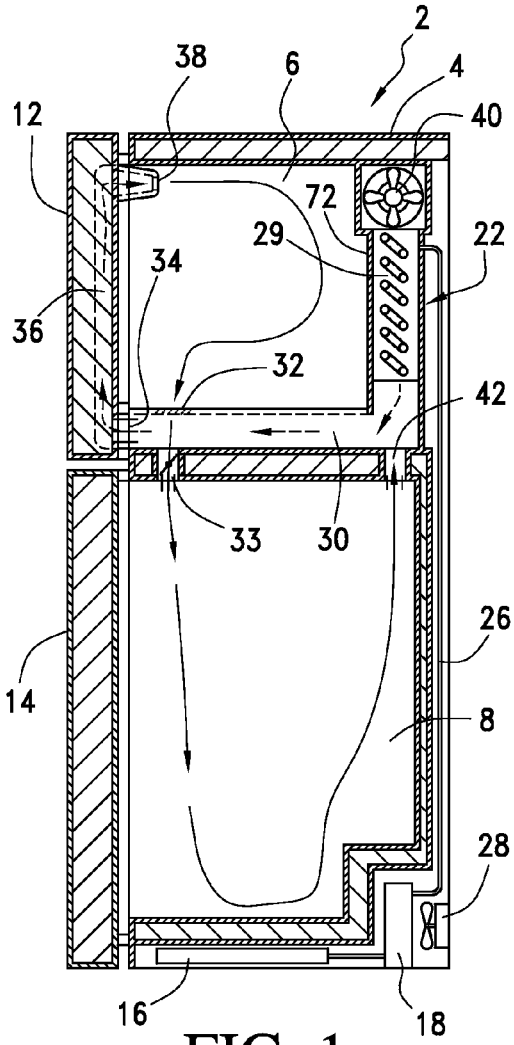
FIG. 1 shows a cross-sectional right side view of a refrigerator including a first arrangement of an evaporator assembly of the present invention.

With initial reference to FIG. 1, a refrigerator 2 includes a cabinet 4 housing two food storage cavities, a first upper cavity 6 and a second lower cavity 8, for storing food or other articles to be cooled or frozen. Cavities 6 and 8 are closed by doors 12 and 14, respectively. In a preferred embodiment, upper cavity 6 constitutes a freezer compartment and lower cavity 8 defines a fresh food compartment. Refrigerator 2 includes an air flow circuit having a condenser assembly 16, a compressor 18, an evaporator assembly 22 and a sealed refrigerant system including tube 26 for connecting these elements. In a manner known in the art, tube 26 contains a refrigerant fluid. Additionally, the air flow circuit preferably includes a condenser fan 28. In accordance with the invention, evaporator assembly 22 includes a tube and fin-type accelerated heat exchanger 29 which will be detailed more fully below.

Figure 2:
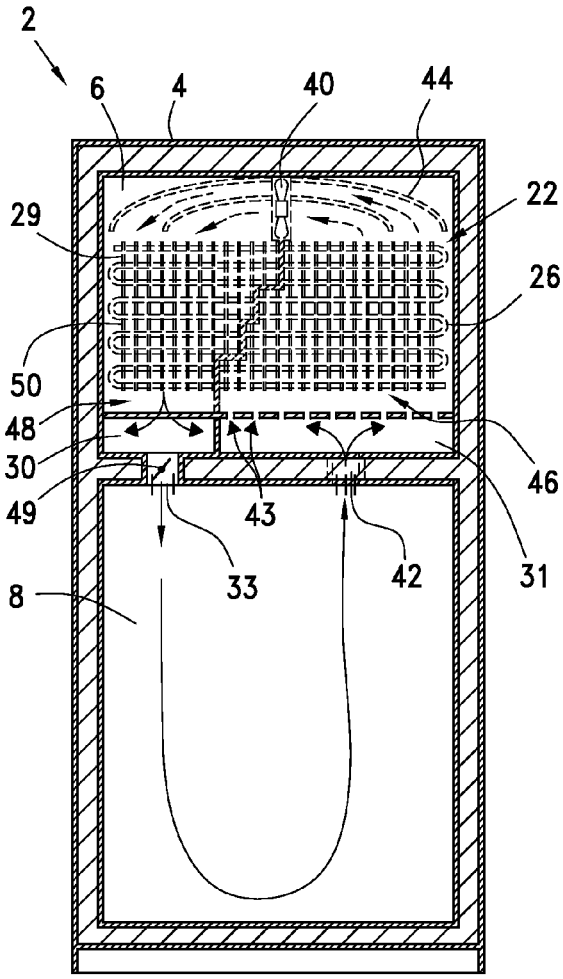
FIG. 2 shows a cross-sectional front side view of the refrigerator of FIG. 1.

In a first arrangement shown in FIGS. 1 and 2, cooled air circulates from evaporator assembly 22 through an air flow channel 30 to vents 32-34. More specifically, a portion of air circulating from evaporator assembly 22 flows through air flow supply channel 30 to vent 33, and through vent 33 into fresh food compartment 8. The remaining portion of air flows through vent 34 to an air flow channel 36 in door 12, and out a top vent 38 in freezer compartment 6. As best seen in FIG. 2, air circulates through freezer compartment 6 before exiting via vents 32 into air flow return channel 30. A fan 40 is employed to cause movement of the cooling air within the circuit. Although depicted as being directly adjacent evaporator assembly 22, fan 40 may be located anywhere within the air flow circuit, as long as it is effective in directing air through the system.

As can be seen in FIG. 2, air exits fresh food compartment 8 through a vent 42 into airflow return channel 31, and then through vent openings 43 in order to circulate through heat exchanger 29 of evaporator assembly 22. The air is cooled by heat exchanger 29 before exiting through vents 32 into air flow supply channel 30 as described above. Preferably, curved baffles 44 direct circulating air cooled from a first air flow passage 46 of heat exchanger 29 into a second air flow passage 48 of heat exchanger 29. The passageways between heat exchanger 29 and the vents of the cooling air circuit can be located and dimensioned according to the specific configuration desired for refrigerator 2. Controls, such as damper valve 49, may be utilized to permit control of the temperature conditions within cavities 6 and 8 as is well known in the art.

Figure 3:
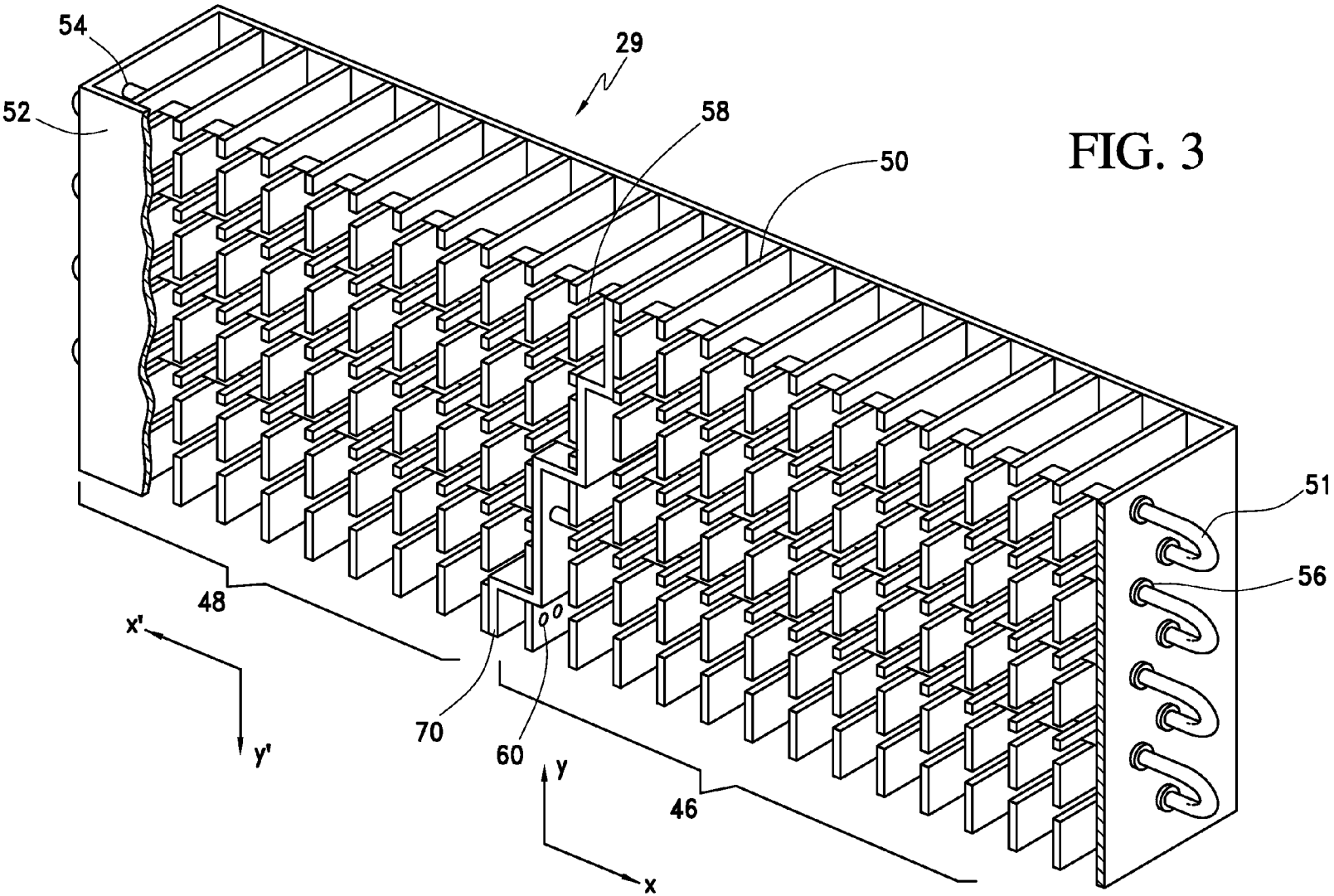
FIG. 3 shows a partial perspective view of an accelerated heat exchanger of the present invention.

FIG. 3 will now be referenced in detailing the structure of heat exchanger 29. Heat exchanger 29 includes a plurality of cooling fins 50 through which a serpentine tube portion 51 of refrigerant tube 26 repeatedly passes. This tube and fin arrangement is preferably mounted in a close fitting housing 52 (shown partially removed) which is open at either end to the cooling air circuit passageway or conduit. It should be understood that housing 52 may be comprised, all or in part, by a refrigerator liner or refrigerator walls. In the embodiment shown, fins 50 are rectangular in shape, equally spaced apart and parallel. However, it should be understood that various types and spacing of fins may be utilized within the context of the present invention, such as split fins, circular fins, spinal fins, spiral fins, etc. Additionally, fins 50 are preferably constructed from a heat conducting metal, such as aluminum, and are relatively thin compared to the length and width of tube 26 in heat exchanger 29.

Housing 52 includes apertures 54 therein for receiving serpentine tube 51 and may additionally include collars 56 projecting from the periphery of apertures 54. Fins 50 are formed with slots 58 therein for receiving serpentine tube 51. In addition to retaining tube 51, slots 58 serve the purpose of allowing for horizontal or lateral air flow within heat exchanger 29. In preferred embodiments, serpentine tube 51 is inserted into slots 58 such that a single length of serpentine tube 51 may be employed in evaporator assembly 22. Alternatively, multiple lengths of tubes may be utilized and connected by return bends at each end (not shown). Other types of apertures, such as perforations 60, may be utilized in addition to slots 58 to further facilitate lateral movement of air within heat exchanger 29.

Figure 12:
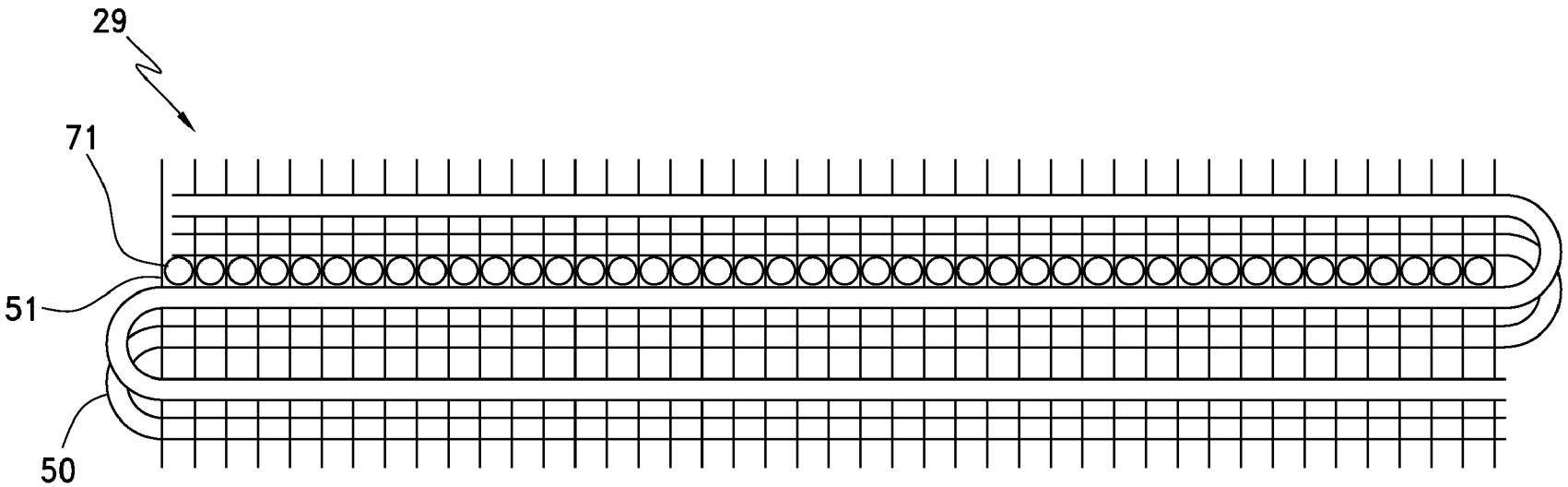
FIG. 12 shows a partial cross-sectional view of a heat exchanger of the present invention including a divider wall comprised of flexible polymer tubes.

A stepped dividing wall 70 partitions heat exchanger 29 into first and second air flow passages 46 and 48 and creates gradually narrowing passageways. In passing through first and second air flow passages 46 and 48, the velocity of cooling air increases as the dimensions of the enclosures, as determined by the dividing wall 70, decrease. More specifically, dividing wall 70 is positioned at an angle with respect to fins 50. The resultant gradual narrowing of first air flow passage 46 in the lateral direction accelerates air flow in the vertical or y direction through heat exchanger 29. Slots 58 and perforations 60 allow for passage of air within heat exchanger 29 in the horizontal or x direction. Likewise, the gradual narrowing of the second air flow passage 48 accelerates air flow in the y' direction, while slots 58 and 60 allow for passage of air within the x' direction. Although shown as stepped, dividing wall 70 may be straight or may be in any other form, so long as divider wall 70 narrows the first and second air flow passages sufficient to cause acceleration of air there through. The length and angle of divider wall 70 may be chosen to obtain the air flow desired within a particular refrigerator system. In one embodiment shown in FIG. 12, dividing wall 70 is comprised of flexible polymer tubes 71, each containing a thermal mass, such as iron filings or a water and alcohol mixture, to provide thermal storage with or without phase change. In this configuration, dividing wall 70 may be arranged parallel to the air flow through heat exchanger 29.

In the arrangement shown in FIG. 1, evaporator assembly 22 is located behind a back wall 72 of enclosure 6, and preferably extends substantially the full width of back wall 72. In this arrangement, the fan 40 is mounted directly adjacent an end portion of dividing wall 70 between the first and second air flow passages 46 and 48. However, it should be understood that the location of evaporator assembly 22, as well as fan 40 and baffles 44, may be altered without departing from the current invention. In an alternative arrangement shown in FIGS. 4-6, a refrigerator 102 includes two food storage cavities, a freezer compartment 106 and a fresh food compartment 108, which are closed by doors 112 and 114, respectively. Refrigerator 102 includes an air flow circuit having a condenser 116, a compressor 118, an evaporator assembly 122, a sealed refrigerant system including fluid tube 126 for connecting these elements, and a condenser fan 128. In accordance with the invention, evaporator assembly 122 also includes heat exchanger 29 located adjacent a bottom wall 130 of freezer compartment 106, and preferably extending substantially the full width of bottom wall 130.

Figure 6:
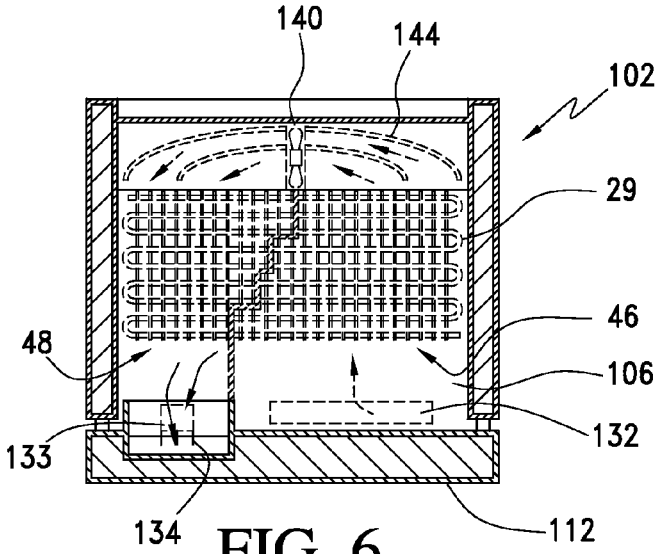
FIG. 6 shows a cross-sectional top side view of the refrigerator of FIG. 4.
Figure 5:
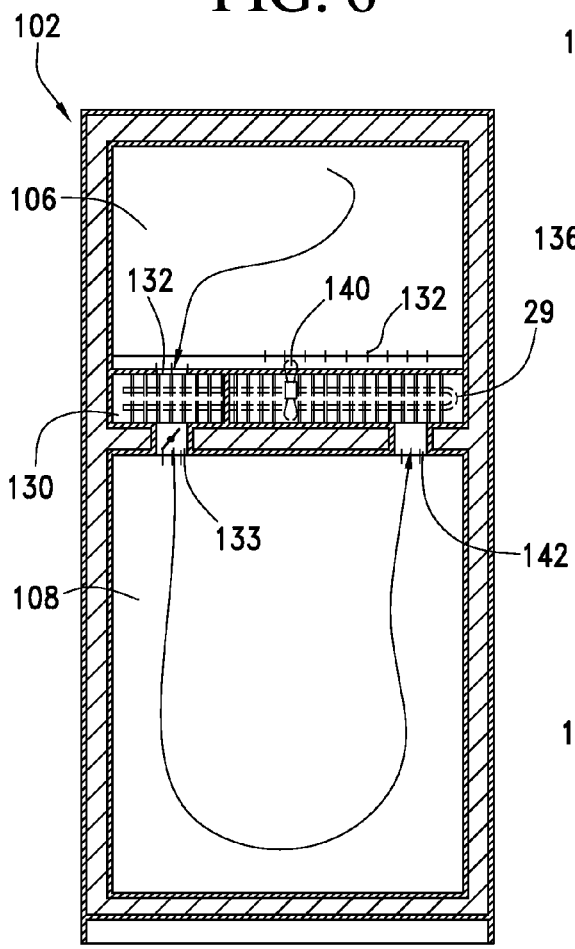
FIG. 5 shows a cross-sectional front side view of the refrigerator of FIG. 4.
Figure 4:
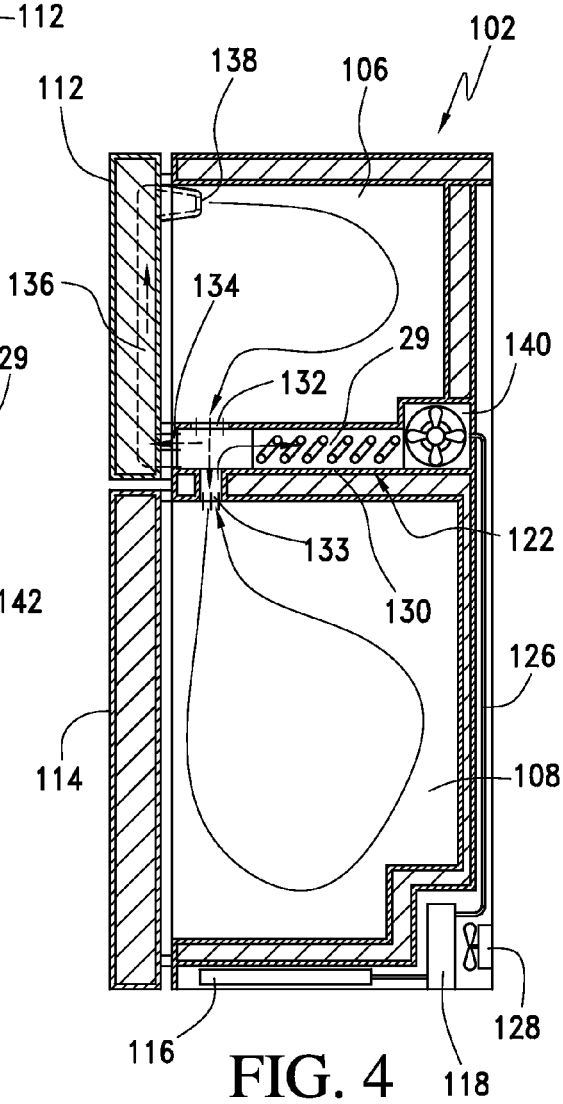
FIG. 4 shows a cross-sectional right side view of a refrigerator including a second arrangement of the evaporator assembly of the present invention.

In the air flow circuit depicted in FIGS. 4-6, cooled air circulates from evaporator assembly 122 through vents 132-134. More specifically, a portion of air circulating from evaporator assembly 122 flows through vent 133 into fresh food compartment 108. The remaining portion of air flows through vent 134 to an air flow channel 136 in door 112, and out a top vent 138 in freezer compartment 106. Air circulates through freezer compartment 106 before exiting via vent 132. A fan 140 is employed to cause movement of the cooling air within the circuit. As best seen in FIG. 5, air exits fresh food compartment 108 through a vent 142, and circulates through heat exchanger 29 where it is cooled before exiting through vents 133 and 134 as described above. Preferably, curved baffles 144 direct circulating air cooled from the first air flow passage 46 of heat exchanger 29 into the second air flow passage 48 of heat exchanger 29.

Figure 9:
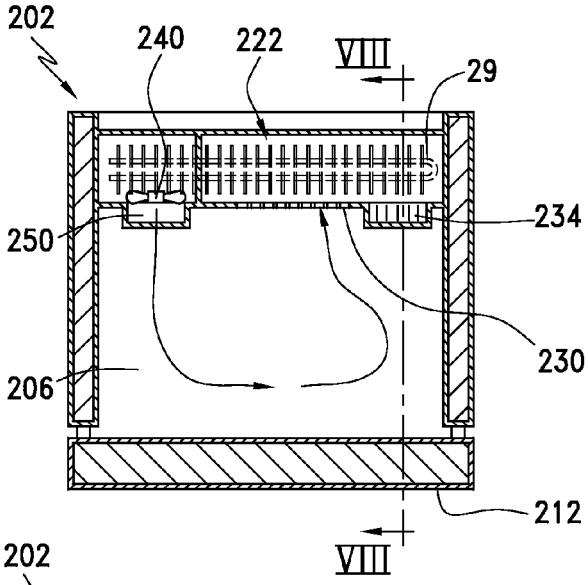
FIG. 9 shows a cross-sectional top side view of the refrigerator of FIG. 7.
Figure 8:
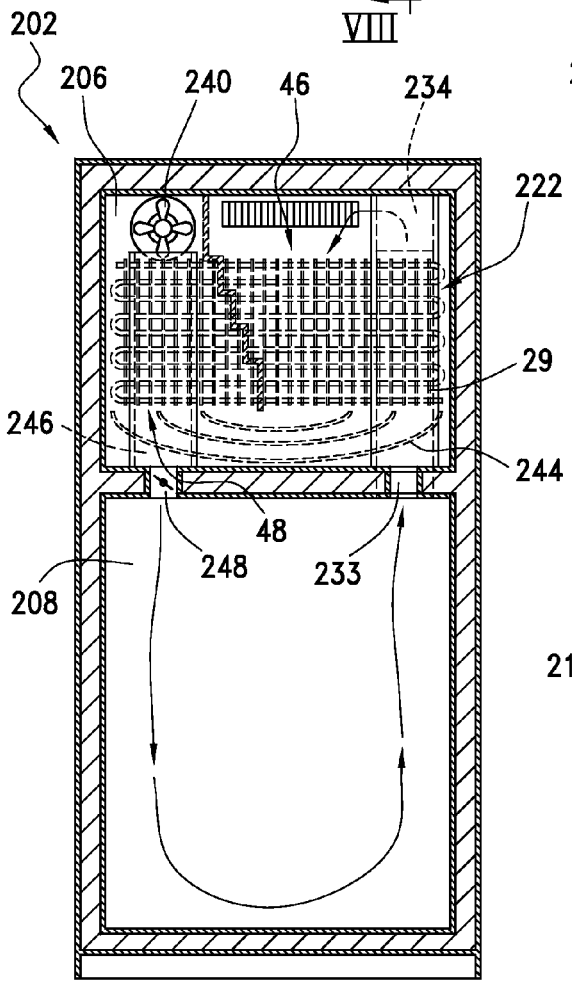
FIG. 8 shows a cross-sectional front side view of the refrigerator of FIG. 7.
Figure 7:
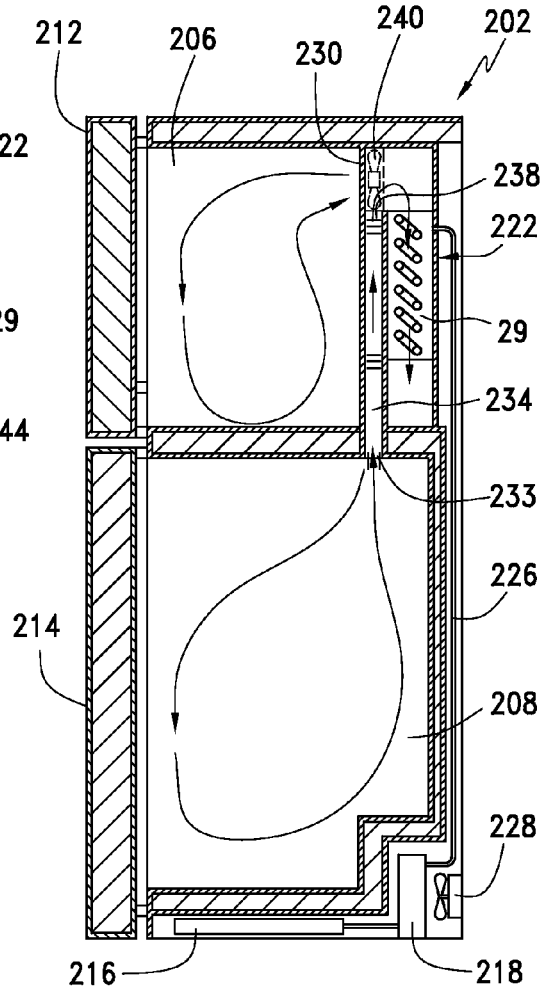
FIG. 7 shows a cross-sectional right side view of a refrigerator including a third arrangement of the evaporator assembly of the present invention.

In a third arrangement shown in FIGS. 7-9, a refrigerator 202 includes two food storage cavities, a freezer compartment 206 and a fresh food compartment 208, which are closed by doors 212 and 214, respectively. Refrigerator 202 includes an air flow circuit having a condenser 216, a compressor 218, an evaporator assembly 222, a sealed refrigerant system including fluid tube 226 for connecting these elements, and a condenser fan 228. In accordance with the invention, evaporator assembly 222 also includes heat exchanger 29 located adjacent a back wall 230 of freezer compartment 206, and preferably extending substantially the full width of back wall 230. As best seen in FIGS. 7 and 8, air exits fresh food compartment 208 through a vent 233 and enters an intake channel 234. Air is then directed by channel 234 to a vent 238 where it is directed through heat exchanger 29. A fan 240 is employed to cause movement of the cooling air within the circuit. Preferably, curved baffles 244 direct circulating air cooled from a first air flow passage 46 of heat exchanger 29 into a second air flow passage 48 of heat exchanger 29. A portion of the cooled air from heat exchanger 29 exits through an exhaust channel 246, where the air is directed through a vent 248 into fresh food compartment 208. The remaining air from heat exchanger 29 exits through a vent 250 and circulates through freezer compartment 206.

Figure 10:
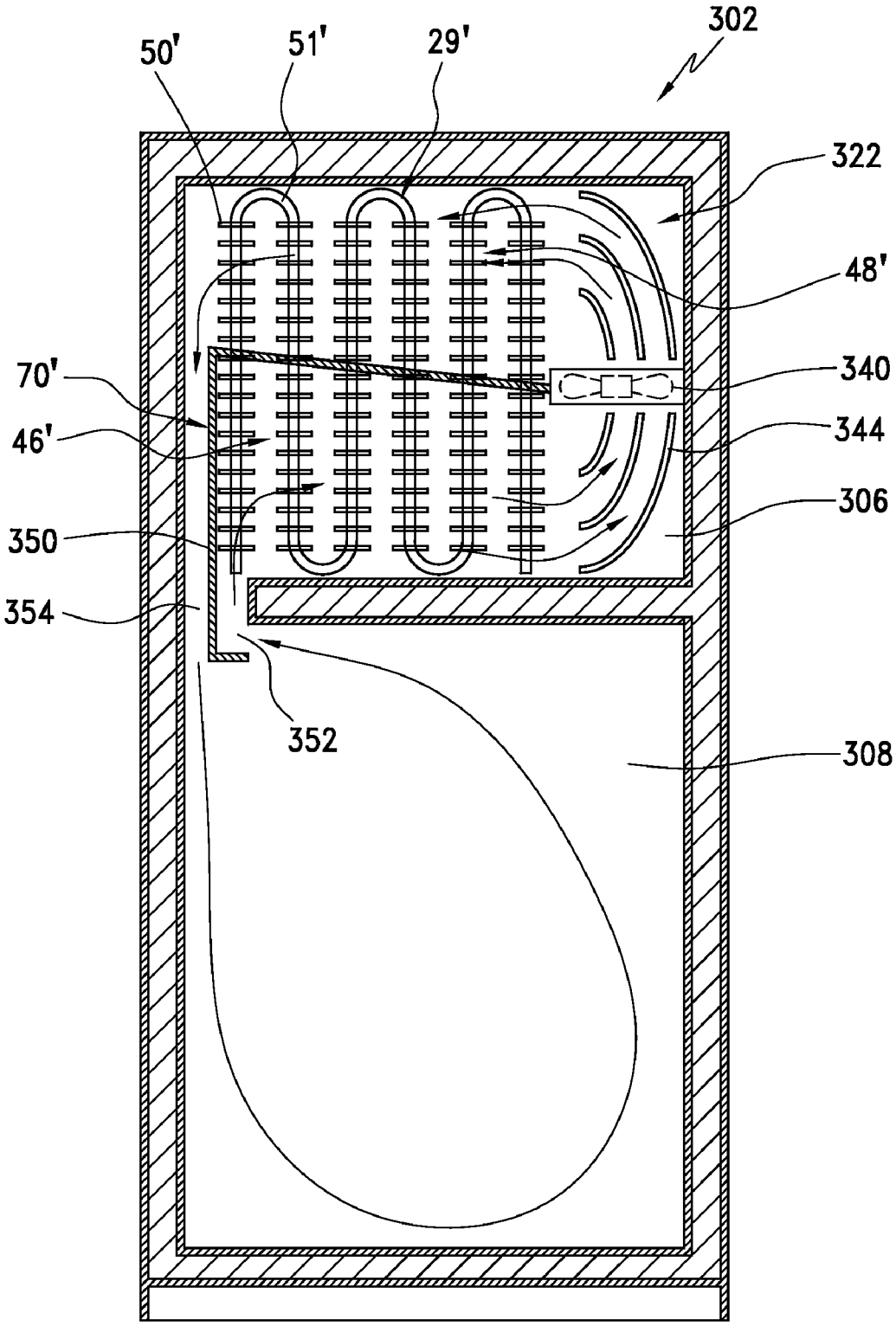
FIG. 10 shows a cross-sectional right side view of a refrigerator including a fourth arrangement of the evaporator assembly of the present invention including an alternative heat exchanger.
Figure 11:
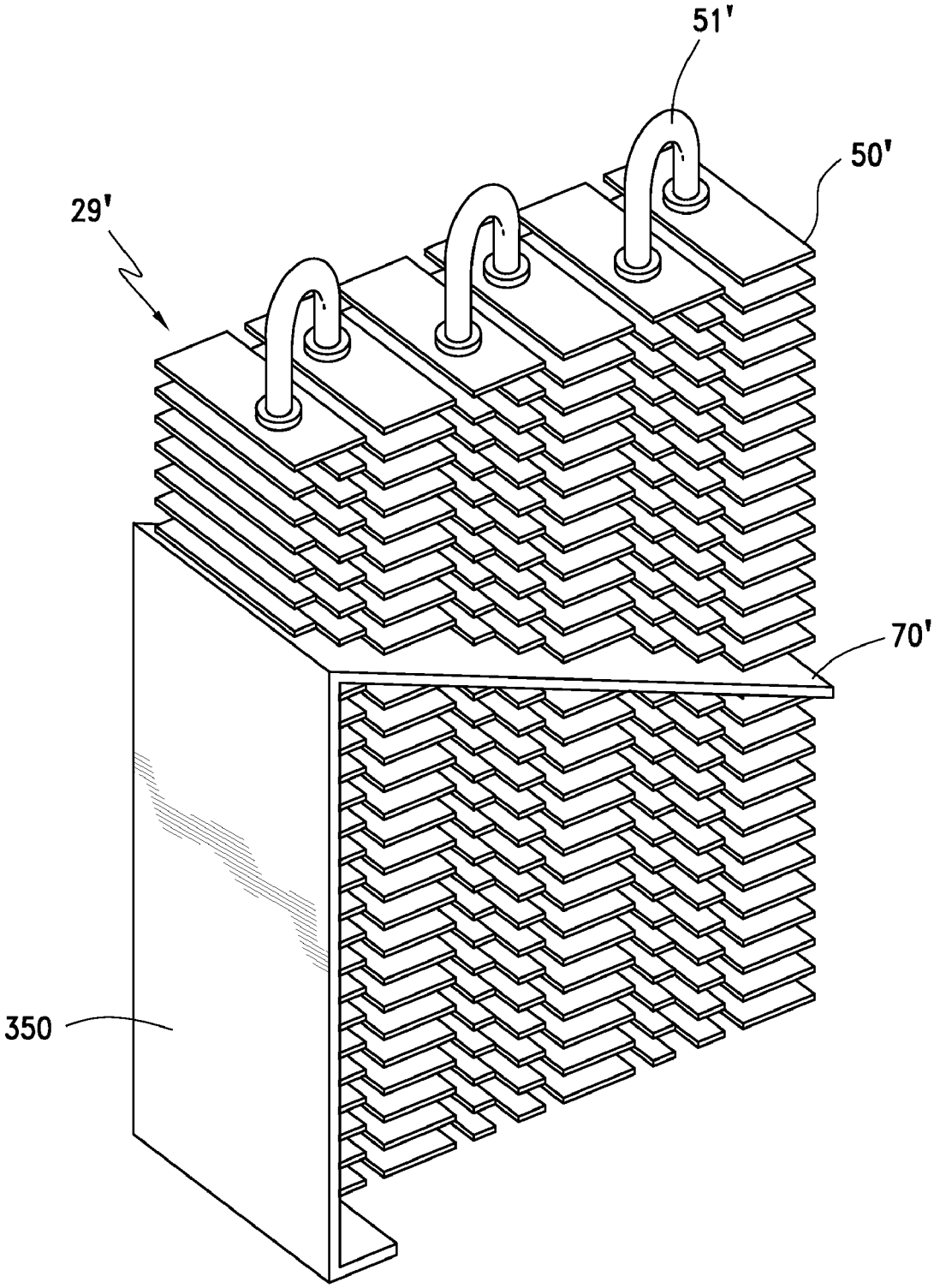
FIG. 11 shows a partial perspective view of the heat exchanger of FIG. 10.

In a fourth arrangement shown in FIG. 10, a refrigerator 302 having freezer and fresh food compartments 306 and 308 includes an evaporator assembly 322. Evaporator assembly 322 utilizes a second embodiment of the heat exchanger of the present invention indicated at 29', having first and second air flow passages 46' and 48'. Heat exchanger 29' includes a plurality of cooling fins 50' through which a serpentine tube portion 51' repeatedly passes. As seen clearly in FIG. 11, a planar dividing wall 70' bifurcates heat exchanger 29' and creates gradually narrowing passageways that serve to accelerate air flow within heat exchanger 29'. Preferably, a fan 340 and curved baffles 344 aid in circulating air within evaporator assembly 322. A side wall 350 extending from divider wall 70' partially defines both an inflow channel 352 and an exhaust channel 354. The length and angle of divider wall 70', as well as the length of side wall 350, may be chosen to obtain the air flow desired within a particular refrigerator system.

Figure 13:
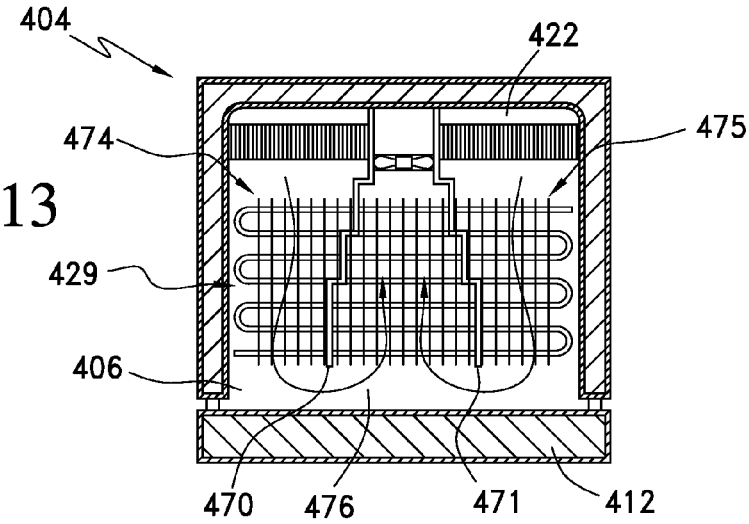
FIG. 13 shows a cross-sectional top view of an alternative heat exchanger having two dividing walls.

In a fifth alternative arrangement shown in FIG. 13, a refrigerator 404 having a freezer compartment 406 closed by a door 412 includes an alternative evaporator assembly 422 extending substantially the entire width of a top wall of freezer compartment 406. Evaporator assembly 422 includes a heat exchanger 429 having first and second dividing walls 470, 471 for partitioning heat exchanger 429 into first and second inflow passageways 474, 475 and an exhaust passageway 476. With this configuration, air flowing into freezer compartment 406 is directed through first and second inflow passageways 474 and 475 to exhaust passageway 476, and subsequently directed out of freezer compartment 406.

Figure 14:
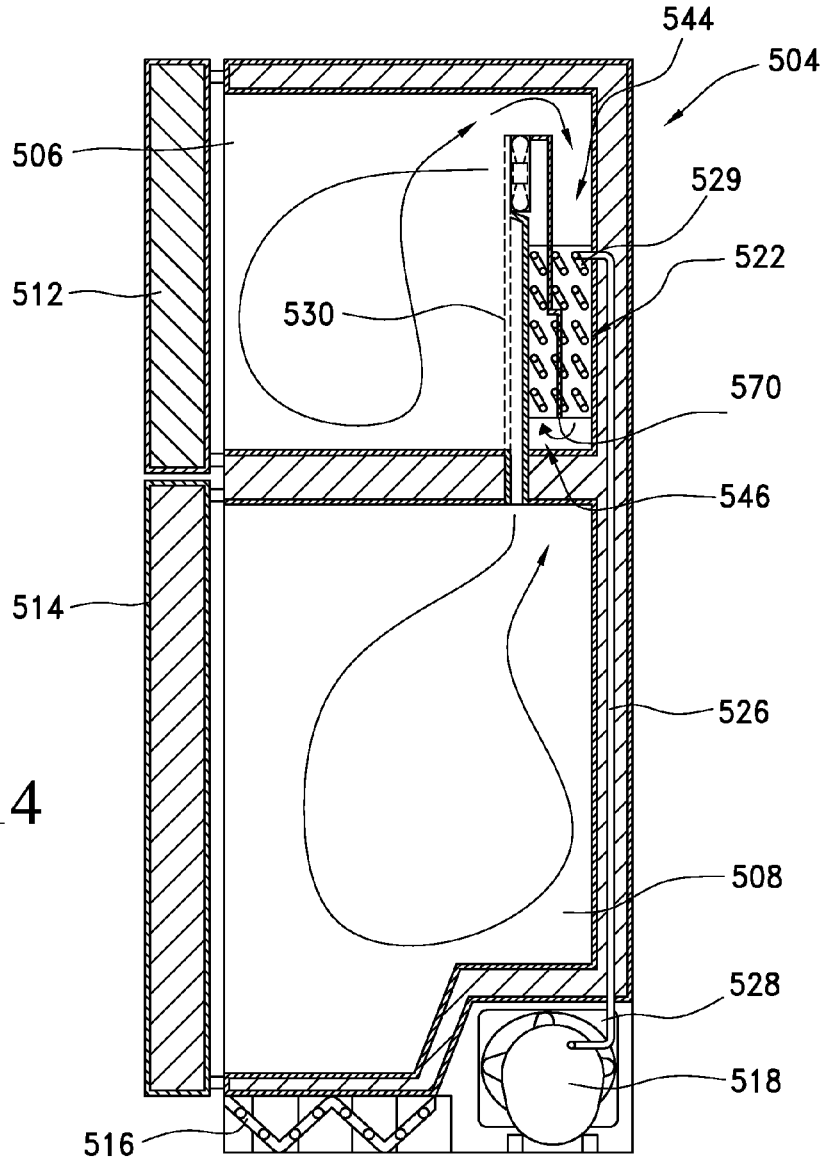
FIG. 14 shows a cross-sectional right side view of a refrigerator including a heat exchanger having a front-to-back flow arrangement.

In a sixth arrangement depicted in FIG. 14, a refrigerator 504 includes a freezer compartment 506 and a fresh food compartment 508 which are closed by doors 512 and 514, respectively. Refrigerator 504 includes an air flow circuit having a condenser 516, a compressor 518, an evaporator assembly 522, a sealed refrigerant system including fluid tube 526 for connecting these elements, and a condenser fan 528. In accordance with the invention, evaporator assembly 522 also includes a heat exchanger 529 located adjacent a back wall 530 of freezer compartment 506. In this configuration, heat exchanger 529 includes longitudinally extending first and second airflow passageways 544 and 546 created by a dividing wall 570. This longitudinally extending dividing wall 570 creates a front-to-back air flow configuration whereby inlet air and outlet air are in-line with one another.

At this point, it should be understood that the present invention is not limited to any particular air flow circuit arrangement, but instead enables the efficient circulation of air within many different types of systems. Additionally, although described with reference to refrigerator evaporator assemblies, it should be readily understood that the heat exchanger of the present invention could be equally applied to condenser assemblies. Furthermore, it should be readily understood that various changes and/or modifications can be made to the invention without departing from the spirit thereof. For instance, the invention is not limited to the fin arrangements shown, but can incorporate many different fin arrangements, so long as the air flow within the heat exchanger is not wholly restricted by the fins in the horizontal and vertical directions. In general, the invention is only intended to be limited by the scope of the following claims.

What is claimed is:

1. A refrigerator comprising:

a cabinet;

a fresh food compartment arranged in the cabinet;

a freezer compartment arranged in the cabinet; and an accelerated heat exchanger assembly located in the cabinet including:

a heat exchanger including a plurality of spaced fins having apertures therein through which a serpentine portion of a fluid tube extends; and a dividing wall extending at an angle with respect to the fins and partitioning the heat exchanger into a first air flow passage leading to a second air flow passage, the first air flow passage having a decreasing cross-sectional dimension generally parallel to the flow of air entering the heat exchanger, and the second air flow passage having a decreasing cross-sectional dimension generally parallel to the flow of air exiting the heat exchanger; whereby the heat exchanger is adapted to accelerate air flow through the heat exchanger.

2. The refrigerator of claim 1, wherein the fins of the accelerated heat exchanger include a plurality of apertures therein, the apertures allowing air flow in both the horizontal and vertical directions.

3. The refrigerator of claim 1, wherein the heat exchanger forms part of an evaporator which extends along substantially the entire width of a back wall of the freezer compartment.

4. The refrigerator of claim 1, wherein the heat exchanger forms part of an evaporator which extends along substantially the entire width of a bottom wall of the freezer compartment.

5. The refrigerator of claim 1, wherein the heat exchanger forms part of an evaporator which extends along substantially the entire width of a top wall of the freezer compartment.

6. The refrigerator of claim 1, further comprising a fan mounted in the freezer compartment for forcibly directing air through each of the first and second air flow passages.

7. The refrigerator of claim 6, wherein, the fan is mounted directly adjacent an end portion of the dividing wall between the first and second air flow passages.

8. The refrigerator of claim 1, wherein the dividing wall is stepped.

9. The refrigerator of claim 1, wherein the dividing wall comprises a plurality of flexible tubes containing a thermal mass.

10. The refrigerator of claim 1, further comprising baffles adapted to further direct air flow between first and second flow passages within the assembly.

11. The refrigerator of claim 1, wherein the heat exchanger forms part of a condenser located in a machine compartment of the cabinet.

12. An accelerated heat exchanger for a refrigerator comprising:

a plurality of spaced fins having apertures therein through which a serpentine portion of a fluid tube extends; and a dividing wall extending at an angle with respect to the fins and partitioning the heat exchanger into a first air flow passage leading to a second air flow passage, the first air flow passage having a decreasing cross-sectional dimension generally parallel to the flow of air entering the heat exchanger, and the second air flow passage having a decreasing cross-sectional dimension generally parallel to the flow of air exiting the heat exchanger, whereby the heat exchanger is adapted to accelerate air flow through the heat exchanger.

13. The accelerated heat exchanger of claim 12, wherein the fins of the accelerated heat exchanger include a plurality of apertures therein.

14. The accelerated heat exchanger of claim 12, wherein the dividing wall is stepped.

15. The accelerated heat exchanger of claim 12, wherein the dividing wall comprises a plurality of flexible tubes containing a thermal mass.

16. A method for circulating air within a refrigerator having at least one cavity comprising:

directing air from the first cavity into a first air flow passage of a heat exchanger including spaced fins having apertures therein through which a serpentine portion of a fluid tube extends, wherein the first air flow passage is separated from a second air flow passage of the heat exchanger by a dividing wall;

accelerating air flow through the first air flow passage, thereby altering the temperature of the air;

directing air exiting the first air flow passage into the second air flow passage of the heat exchanger; and accelerating air flow through the second air flow passage, thereby further altering the temperature of the air.

17. The method of claim 16, further comprising: directing the air exiting the first air flow passage into the second air flow passage across a curved baffle.

18. The method of claim 16, wherein the angle of the dividing wall within the heat exchanger determines the amount of acceleration through the first and second air flow passages.

19. The method of claim 16, wherein the dividing wall is stepped.

20. The method of claim 16, wherein the cooling fins have apertures therein, the apertures allowing fluid flow in both the horizontal and vertical directions.

21. The method of claim 16, wherein the dividing wall is arranged parallel to the air flow.

* * * * *